US005975297A

United States Patent [19]

Kao

[11] Patent Number: 5,975,297

[45] Date of Patent: Nov. 2, 1999

[54] SOCKET HOLDING DEVICE

[76] Inventor: Jui-Chien Kao, No. 358, Tunghsing Rd., Shuwang Li, Tali City, Taichung Hsien, Taiwan

[21] Appl. No.: 09/102,168

[22] Filed: Jun. 22, 1998

[51] Int. Cl.[6] ..... B65D 85/28

[52] U.S. Cl. ..... 206/378; 206/493; 206/806

[58] Field of Search ..... 206/374, 375, 206/376, 377, 378, 372, 373, 493, 349, 806; 211/70.6, 60.1, 94.01; 81/177.4, 177.85, 462

[56] References Cited

U.S. PATENT DOCUMENTS 4,302,990 12/1981 Chrichton et al. ..... 206/378
4,905,830 3/1990 Lin ..... 206/806
5,228,570 7/1993 Robinson ..... 206/378
5,740,911 4/1998 Chou ..... 206/378

*Primary Examiner*—Paul T. Sewell
*Assistant Examiner*—Nhan T. Lam
*Attorney, Agent, or Firm*—Sixbey, Friedman Leedom & Ferguson; Stuart J. Friedman

[57] ABSTRACT

A device for holding sockets includes a body with two rails formed to two sides thereof and a plurality of connecting members are slidably mounted to the rails. A head member is disengagably engaged to the body so as to attach the device to a user's belt. Each of the connecting members has a socket mounted thereto. The body further has a retaining member formed thereto so that a ratchet tool is removably retained by the retaining member.

13 Claims, 6 Drawing Sheets

SOCKET HOLDING DEVICE

FIELD OF THE INVENTION

The present invention relates to a device for collecting sockets to two sides thereof, a ratchet tool attached thereto and a head member to which a user's belt is clamped.

BACKGROUND OF THE INVENTION

Sockets are designed to be attached to ratchet tools to tighten or loosen a bolt or a nut, such sockets have different sizes so as to fit bolts or nuts with different sizes. A user has to carry many sockets if he/she wants to use the ratchet tool, generally, a tool box or socket box is carried with him/her so as to conveniently hold the sockets. Generally a typical tool box is so large that it is inconvenient to be carried and occupies too much space on site.

The present invention intends to provide a simple and compact socket holding device which has a body with two rails formed to two sides thereof so that sockets are slidably mounted to the rails and a head member is conveniently and disengagably engaged to the body so that the device can be clamped to a user's belt. Furthermore, a ratchet tool is removably attached to the body. The device of the present invention therefore mitigates and/or obviates the disadvantages of the conventional tool/socket boxes.

SUMMARY OF THE INVENTION

In accordance with one aspect of the present invention, there is provided a device for holding sockets and comprising a body having a first end with a first engaging member formed thereto and a second end, each of two sides of the body having a plurality of connecting members extending therefrom to which sockets are mounted. A head member has a second engaging member formed to the first end thereof so as to be disengagably engaged with the first engaging member and a clamp member formed to a second end thereof so as to be attached to a user's belt.

It is an object of the present invention to provide a socket holding device which has a compact size.

It is another embodiment of the present invention to provide the socket holding device which is conveniently attached to the user's belt.

Further objects, advantages, and features of the present invention will become apparent from the following detailed description with appropriate reference to the accompanying drawings.

DETAILED DESCRIPTION OF THE PREFERRED EMBODIMENTS

Figure 1:
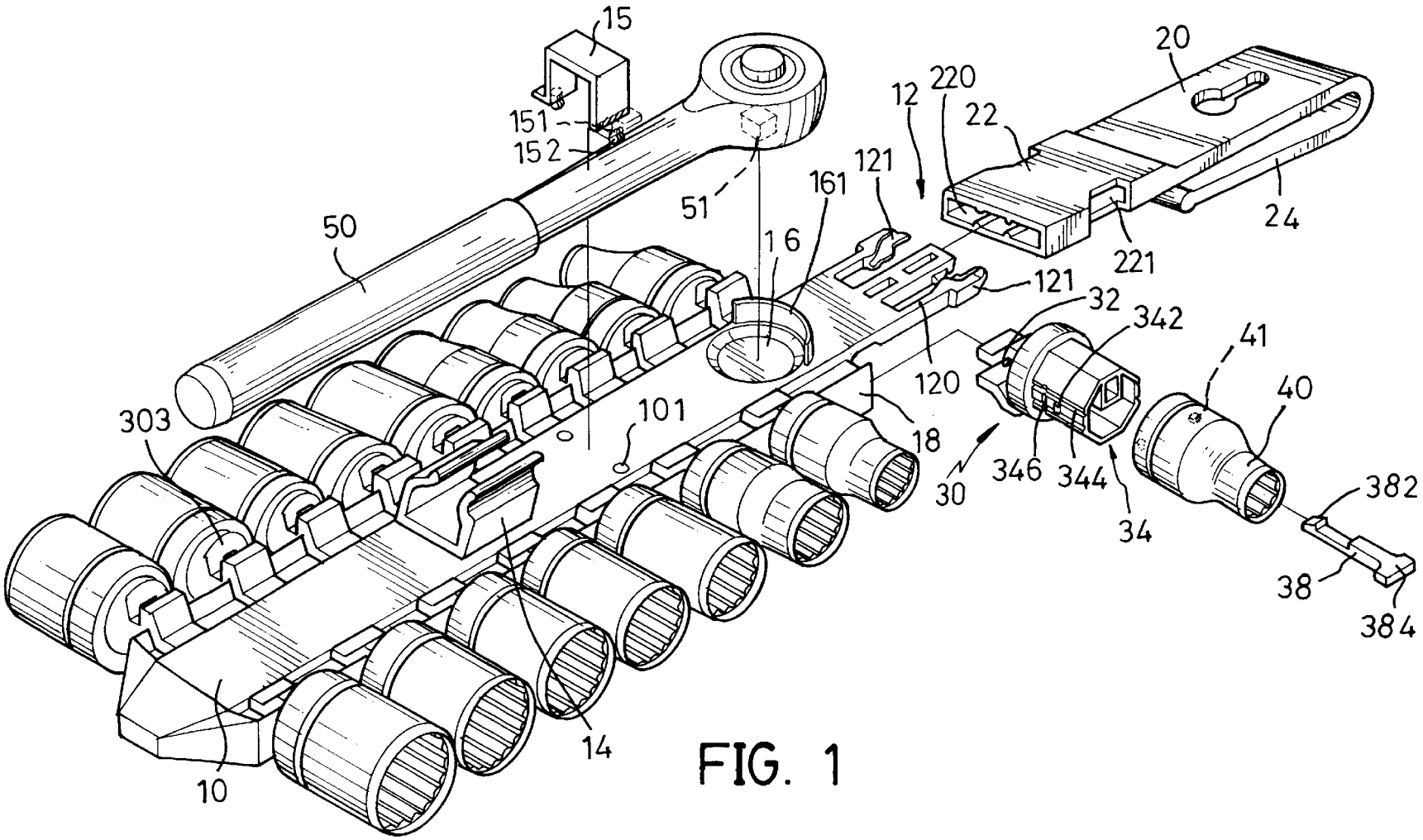
FIG. 1 is an exploded view of the socket holding device and one of the sockets attached to the connecting member of the device in accordance with the present invention, wherein the connecting member is an eight-sided polyhedron.
Figure 2:
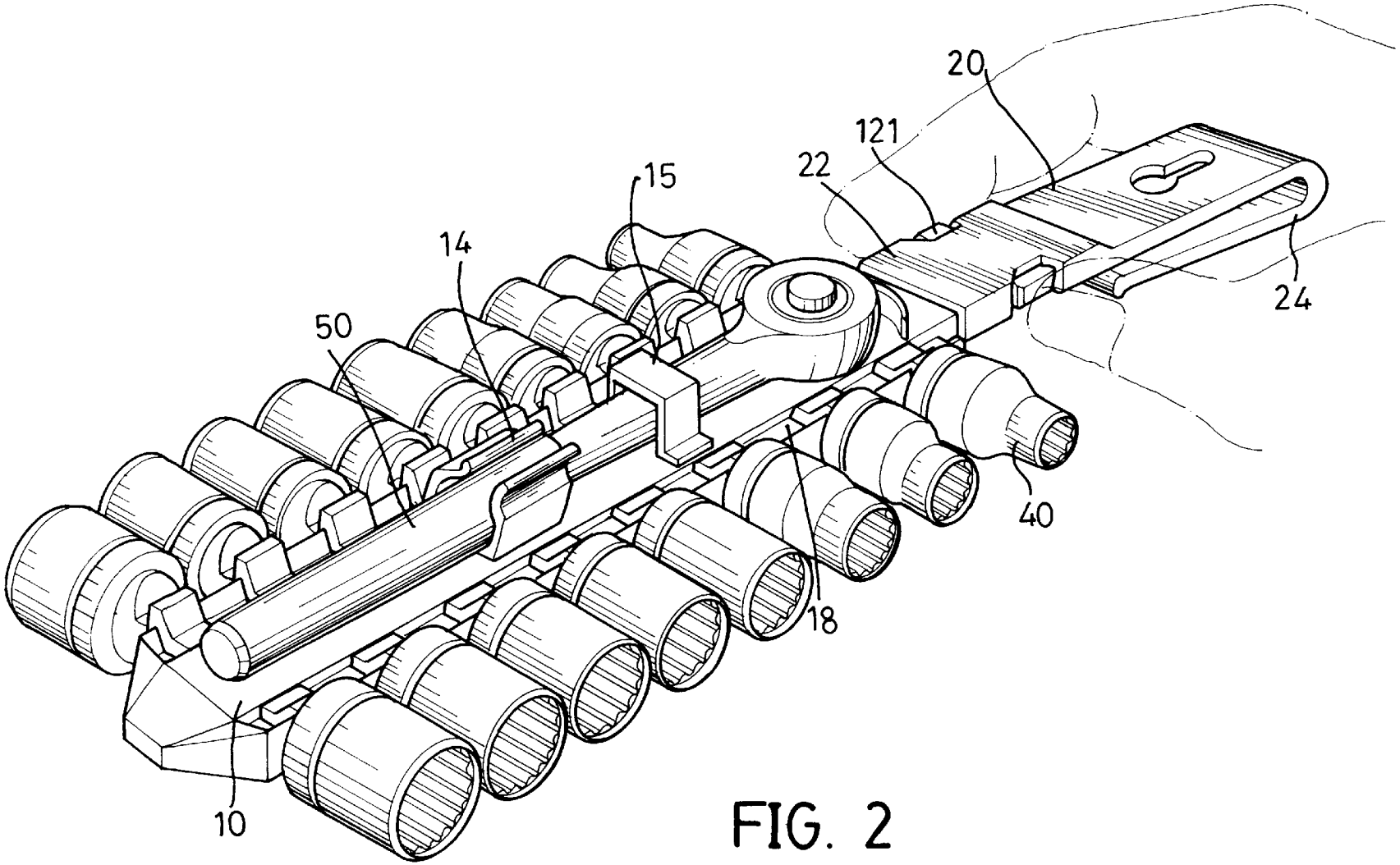
FIG. 2 is a perspective view of the device in accordance with the present invention and the head member is to be disengaged form the body of the device by a hand shown in phantom lines.
Figure 3:
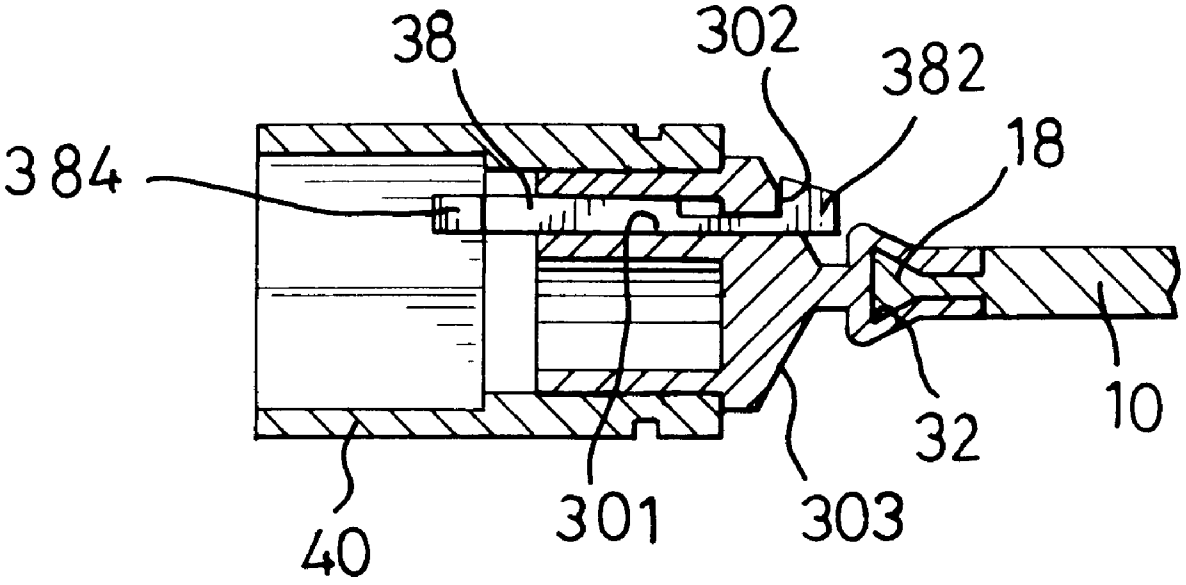
FIG. 3 is a side elevational view, partly in section, of the socket attached to the connecting member of the device and locked by a locking member.
Figure 4:
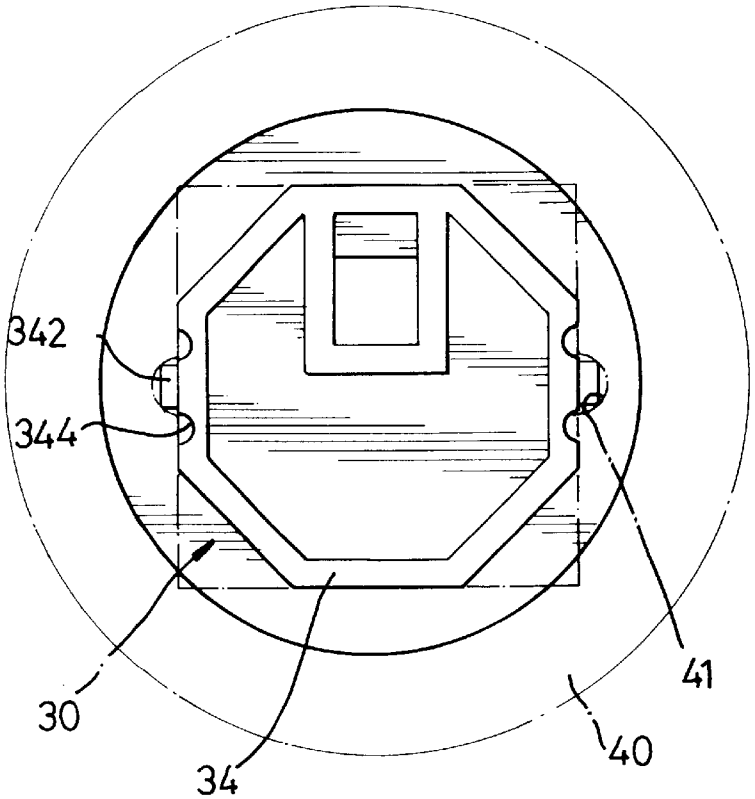
FIG. 4 is an end illustrative view to illustrate a socket mounted to the tubular member shown in FIG. 1.

Referring to FIGS. 1 and 2, a device for holding sockets comprises a longitudinal body 10 having a first end with a first engaging member 12 formed thereto and a second end. The first engaging member 12 is a male engaging member and has two flexible legs 120 extending therefrom, each of the flexible legs 120 having a hook portion 121 formed thereto. Each of two sides of the body 10 has a rail 18 formed thereto and each rail 18 has a dove-tailed cross section so that a plurality of connecting members 30 may slidably mount to the two rails 18. Each of the connecting members 30 has a first end having a cone-shaped portion 303 extending therefrom from which two plates extend so as to define a dove-tailed recess 32 therebetween so as to receive the corresponding rail 18 therein and a second end with a tubular member 34 extending therefrom which has a polygonal cross section, an eight-faced polyhedron for example (FIG. 4). Each tubular member 34 has two bosses 342 extending radially, outwardly and diametrically from an outer periphery thereof so that a socket 40 can be mounted to the tubular member 34 with the two bosses 342 being received in two dents 41 defined in the inner periphery of one of two ends of the socket 40 as shown in FIG. 4. Referring to FIG. 3, each of the connecting members 30 has a passage 301 defined longitudinally therethrough so as to define an engaging hole 302 in the cone-shaped portion 303 of the first end thereof. The connecting member 30 has a passage 301 defined longitudinally therethrough so as to define an engaging hole 302 in the first end thereof. Each of the tubular members 34 is meshed with a locking member 38 to position the socket 40 to the corresponding tubular member 34, the locking member 38 can be inserted into the passage 301 and has a hook end 382 formed to the first end thereof which is then engaged with the engaging hole 302 of the connecting member 30 corresponding thereto so that the socket 40 is well locked with respect to the tubular member 34 and prevents it from being removed without authorized permission especially when displayed in a store. That is to say, the hook end 382 has to be cut so that the socket 40 can be pulled from the tubular member 30 corresponding thereto. A bar 384 transversely is connected to the second end of the locking member 38 so as to be conveniently held by the fingers.

Each of the tubular members 34 has two pairs of first grooves 344 defined in the outer periphery thereof so that each pair of the first grooves 344 has one of the two respective bosses 342 located therebetween. Each of the tubular members 34 further has two second grooves 346 which are respectively defined in the outer periphery thereof and located transversely to the corresponding pair of first grooves 344. Each of the second grooves 346 aligns with the corresponding pair of the first grooves 344 and are located near the first end of the connecting member 30 so that when a socket 40 is mounted to the tubular member 34, a slight deformation of the areas where the two bosses 342 are located is allowed.

A retaining member 14 is formed on an upper surface of the body 10 and a recess 16 is defined in the upper surface of the body 10 so that a ratchet tool 50 can be attached to the body 10 with the handle of the ratchet tool 50 retained by the retaining member 14 and the driving shaft 51 of the ratchet tool 50 is received in the recess 16. The body 10 further has a curved stop 161 extending from the upper surface thereof so that the recess 16 is located between the curved stop 161 and the retaining member 14. The curved stop 161 is designed to prevent the ratchet tool 50 from being pulled from the retaining member 14. An U-shaped limiting member 15 is further removably connected to the upper surface of the body 10 which has two holes 101 defined therethrough, the limiting member 15 having two pin members 151 extending from the two lower ends thereof and each of the pin members 151 comprises two pieces and each piece having an enlarged head 152 such that the limiting member 15 is connected to the body 10 by force-fitting the two pieces through the holes 101. It is to be noted that the limiting member 15 can be removed from the body 10 only by cutting the two pieces. The locking members 38 and the limiting member 15 are only used before the sockets 40 and the ratchet tool 50 are dismantled from the body 10 the first time.

A head member 20 has a second engaging member 22 formed to a first end thereof so as to be disengagably engaged with the first engaging member 12. The second engaging member 22 is a female engaging member with a slot 220 defined longitudinally therein, two apertures 221 defined through a peripheral wall of the second engaging member 22 and communicating with the slot 220 such that the first engaging member 12 is engaged with the second engaging member 22 by inserting the two legs 120 into the slot 220 and the two head portions 121 are engaged with the apertures 221. A clip member 24 is formed at the second end of the head member 20 so as to be conveniently attached to a user's belt (not shown).

Figure 6:
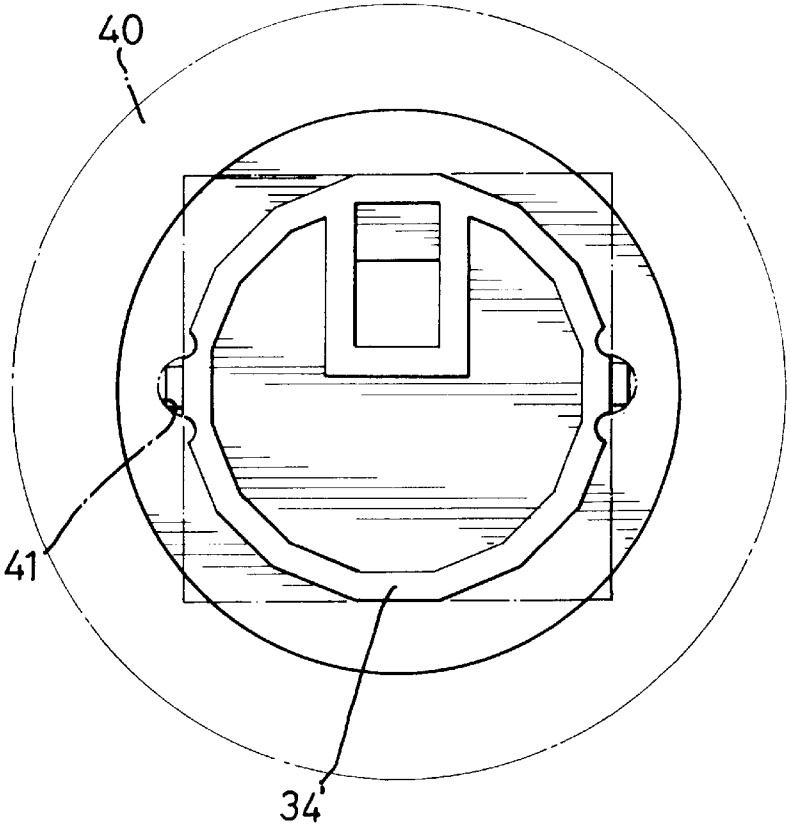
FIG. 6 is an end illustrative view to illustrate a socket mounted to the tubular member shown in FIG. 5.
Figure 5:
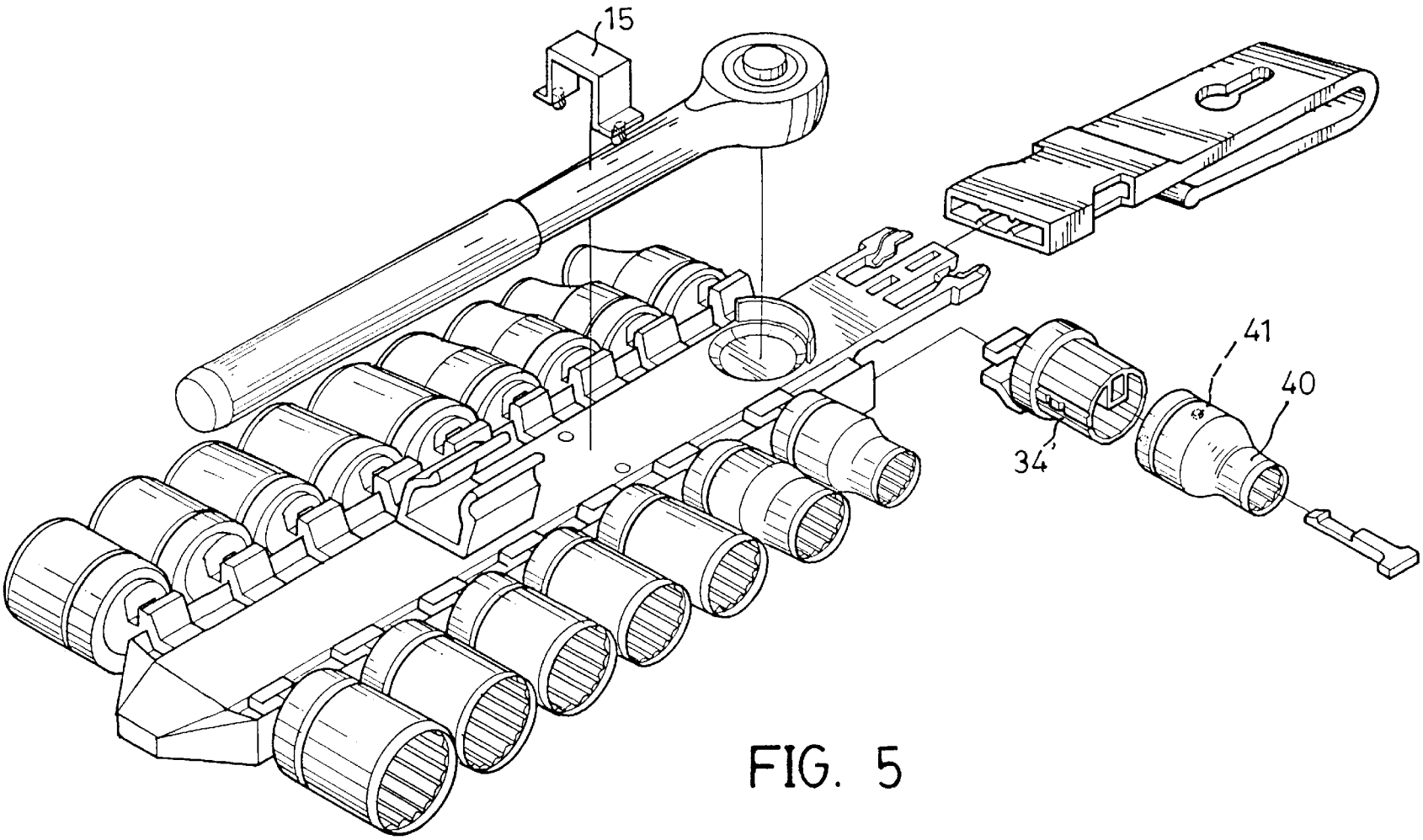
FIG. 5 is an exploded view of another embodiment of the socket holding device and one of the sockets attached to the connecting member of the device in accordance with the present invention, wherein the connecting member is a sixteen-sided polyhedron.
Figure 7:
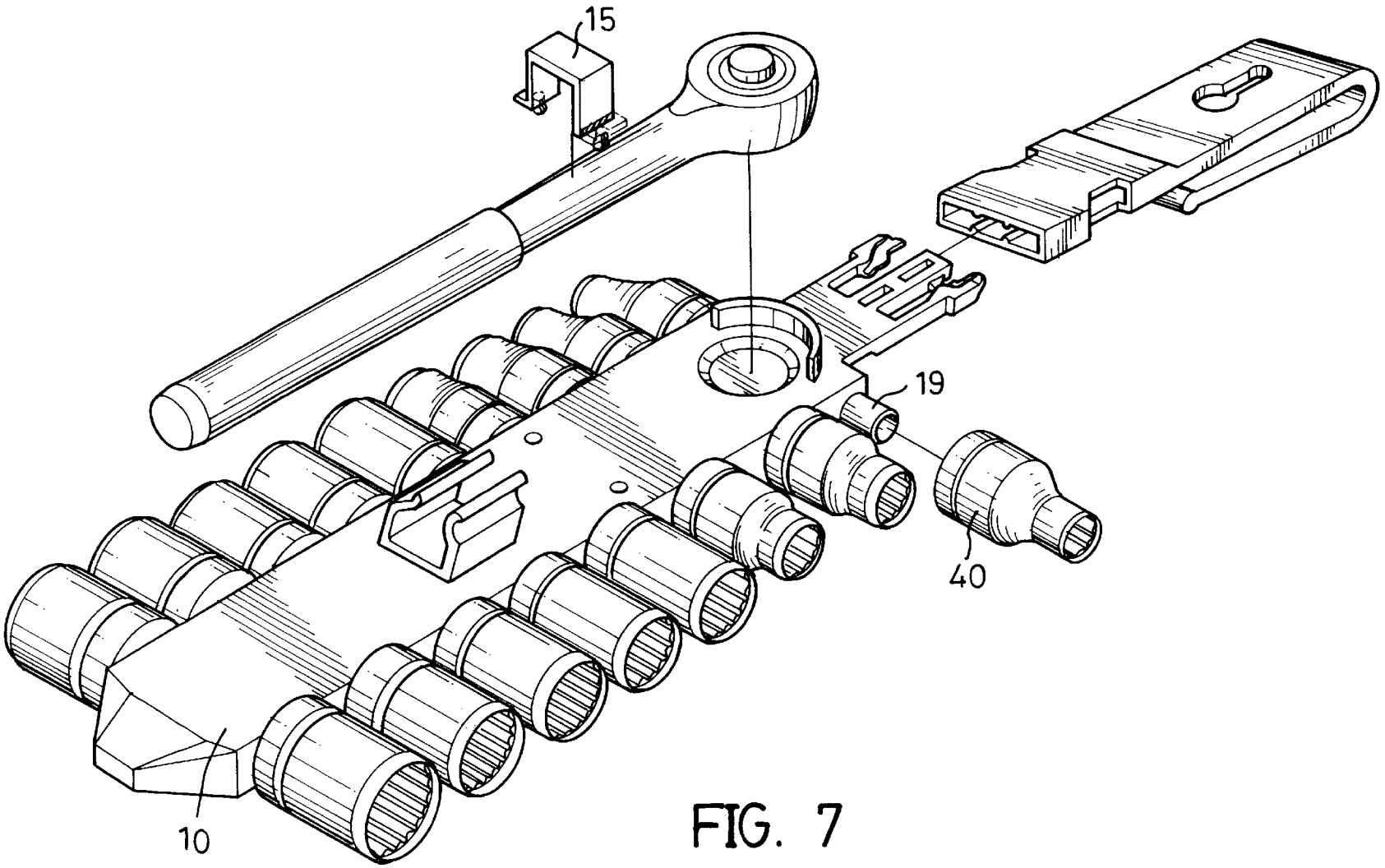
FIG. 7 is an exploded view of yet another embodiment of the socket holding device and one of the sockets attached to the connecting member of the device in accordance with the present invention, wherein the connecting member is a tubular member.

FIGS. 5 and 6 show another embodiment of the tubular member 34' of the present invention, wherein the tubular member 35 has a sixteen-faced polyhedron which is received in the end of the socket 40 having dents 41 defined in the inner periphery thereof. FIG. 7 shows yet another embodiment of the connecting members wherein a plurality of tubes 19 extend from two sides of the body 10 and each of the tubes 19 is sized to be snugly received in the end of the socket 40.

Accordingly, the device of the present invention can be conveniently attached to the user's belt and has the ratchet tool 50 and a plurality of sockets 40 with different sizes and specifications attached thereto so that the device includes necessary parts to complete a job. Furthermore, the head member 20 can be quickly disengaged form the body 20 when needed.

Although the invention has been explained in relation to its preferred embodiment, it is to be understood that many other possible modifications and variations can be made without departing from the spirit and scope of the invention as hereinafter claimed.

What is claimed is:

1. A device for holding sockets, comprising:

a body having a first end with a first engaging member formed thereto and a second end, two rails respectively formed on two sides of said body and each of said rails having a dove-tailed cross section, at least one connecting member connected to each of said two rails and each connecting member having a first end with a dove-tailed recess defined therein so as to receive said corresponding rail therein and a second end with a tubular member extending therefrom, and a head member having a second engaging member formed on the first end thereof so as to be disengagably engaged with said first engaging member and a clip member formed on the second end thereof.

2. The device as claimed in claim 1 further comprising a cone-shaped portion extending from said first end of each connecting member and two plates extending from said cone-shaped portion so as to define said dove-tailed recess therebetween.

3. The device as claimed in claim 1, wherein said tubular member has a polygonal cross section.

4. The device as claimed in claim 1, wherein each tubular member has two bosses extending radially, outwardly and diametrically from an outer periphery thereof.

5. The device as claimed in claim 1, wherein said first engaging member is a male engaging member with two flexible legs extending therefrom, each of said flexible legs having a hook portion formed thereon, said second engaging member being a female engaging member with a slot defined therein, two apertures defined through a peripheral wall of said second engaging member and communicating with said slot such that said first engaging member is engaged with said second engaging member by inserting said two legs into said slot and said two head portions are engaged with said apertures.

6. The device as claimed in claim 1 further comprising a retaining member formed to one of two surfaces of said body and a recess defined in the same surface of said body where said retaining member is located.

7. The device as claimed in claim 6 further comprising a curved stop extending from said surface of said body so that said recess is located between said curved stop and said retaining member.

8. The device as claimed in claim 6 further comprising an inverted U-shaped limiting member removably connected to said surface of said body which has two holes defined therethrough, said limiting member having two pin members extending from two lower ends thereof and each of said pin members comprising two pieces and each piece having an enlarged head such that said limiting member is connected to said body by force-fitting said two pieces through said holes.

9. The device as claimed in claim 1, wherein each of said connecting members has a passage defined therethrough so as to define an engaging hole in a first end thereof, each connecting member having a locking member inserted into said passage and said locking member having a hook end formed on a first end thereof so as to be engaged with said engaging hole of said connecting member corresponding thereto.

10. The device as claimed in claim 9, wherein each tubular member has two pairs of first grooves defined in said outer periphery thereof and one of said two respective bosses is located between said pair of said first grooves corresponding thereto.

11. The device as claimed in claim 10, wherein each tubular member has two second grooves respectively defined in said outer periphery thereof and each second groove is located transversely to and aligns with said the corresponding pair of said first grooves.

12. The device as claimed in claim 11, wherein one of said two respective second grooves is located near said first end of said connecting member corresponding thereto.

13. The device as claimed in claim 9 further comprising a bar transversely connected to a second end of each of said locking members.

* * * * *